US007719497B2

(12) United States Patent
Cho et al.

(10) Patent No.: US 7,719,497 B2
(45) Date of Patent: May 18, 2010

(54) CURRENT FEEDBACK-TYPE AMOLED WHERE SENSE FEEDBACK IS SENT OVER THE ADJACENT DATA LINE

(75) Inventors: Gyu Hyeong Cho, Banpo-myeong Gongju-si (KR); Sang-kyung Kim, Daejeon (KR); Young-suk Son, Taean-eup Whaseong-si (KR); Yong-joon Jeon, Daejeon (KR); Jin-yong Jeon, Daegu (KR); Gun-ho Lee, Kyonggido (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 724 days.

(21) Appl. No.: 11/633,984

(22) Filed: Dec. 4, 2006

(65) Prior Publication Data

US 2007/0139311 A1 Jun. 21, 2007

(30) Foreign Application Priority Data

Dec. 5, 2005 (KR) ..... 10-2005-0117484

(51) Int. Cl.
*G09G 3/32* (2006.01)

(52) U.S. Cl. ..... 345/82

(58) Field of Classification Search ..... 345/82
See application file for complete search history.

(56) References Cited

U.S. PATENT DOCUMENTS 5,151,689 A * 9/1992 Kabuto et al. ..... 345/103
6,433,488 B1 8/2002 Bu
2002/0101172 A1 * 8/2002 Bu ..... 315/169.3
2007/0120780 A1 * 5/2007 Park et al. ..... 345/76

OTHER PUBLICATIONS

Hai-Jung Im et al. "P-8: A Novel Feedback-Type AMOLEDs Driving Method for Large-Size Panel Applications" SID 05 Digest.

* cited by examiner

*Primary Examiner*—Richard Hjerpe
*Assistant Examiner*—Andrew Schnirel
(74) *Attorney, Agent, or Firm*—Bachman & LaPointe, P.C.

(57) ABSTRACT

A current feedback-type AMOLED driving circuit. The current feedback-type AMOLED driving circuit includes a plurality of pixel circuits each having a data terminal for receiving a pixel current command, and a sense terminal for transmitting pixel current to a driver Integrated Circuit (IC), and a plurality of data lines provided such that a single data line is provided for a single column formed by a plurality of pixel circuits, thus data terminals of the pixel circuits, forming the column, are connected to the data line. In the AMOLED driving circuit, two columns are paired, sense terminals of pixel circuits, forming a first column of the two columns, are connected to a data line for a second column, and sense terminals of pixel circuits, forming the second column, are connected to the data line for the first column. The AMOLED driving circuit is operated such that, when the first column is driven, the data line for the second column is used as a current feedback line for the first column, and when the second column is driven, the data line for the first column is used as a current feedback line for the second column. Accordingly, the number of pads of the driver IC is limited to one per column, and price competitiveness of the driver IC is improved.

22 Claims, 15 Drawing Sheets

PRIOR ART

[Figure 1]

CURRENT FEEDBACK-TYPE AMOLED WHERE SENSE FEEDBACK IS SENT OVER THE ADJACENT DATA LINE

BACKGROUND OF THE INVENTION

1. Field of the Invention

The present invention relates, in general, to flat panel display devices using an organic light emitting diode and, more particularly, to a current feedback-type active matrix organic light emitting diode driving circuit, which uses a current driving line for an adjacent column as a current feedback line, thus limiting the number of pads of a driving integrated circuit to one per column.

2. Description of the Related Art

An Organic Light Emitting Diode (hereinafter referred to as an 'OLED') is considered to be a greatly promising display device, along with a Liquid Crystal Display (LCD) and a Plasma Panel Display (PDP). In particular, an OLED has the advantages of being the thinnest, of being lightweight, and of having excellent color reproducibility.

Such an OLED has characteristics indicating that the brightness thereof is adjusted using current, unlike an LCD for adjusting brightness using voltage.

Recently, to satisfy demand for a flat panel display having a bigger size, reproducing more colors, and having a higher response rate, there is a tendency to change a flat panel display from a conventional passive matrix-type flat panel display to an active matrix-type flat panel display.

The Active Matrix OLED (AMOLED) display is constructed so that a great number of OLEDs is distributed in two dimensions, and respective OLEDs are sequentially accessed using Thin Film Transistors (TFTs) which can be integrated on a glass substrate, thus controlling the current of the OLEDs.

A conventional AMOLED display has adopted a method of converting digital graphic data, which is input for each pixel, into analog voltage through digital-analog conversion, applying the analog voltage as a voltage between the gate and source of a driving TFT connected in series with a corresponding OLED, and maintaining the voltage using a storage capacitor.

This method is problematic in that it is very difficult to maintain the current, and moreover, the brightness, of the OLED uniform, due to the non-uniformity of TFTs manufactured using an amorphous silicone (a-Si) or poly-silicone (p-Si) based process.

In order to solve the problem of such a voltage driving method, a pixel structure using a current source or a current mirror has been proposed.

A pixel in such a current driving method is advantageous in that it not only copes with the basic characteristics of an OLED exhibiting brightness proportional to current, but also uses current as an input, thus the adjustment of uniform brightness is possible in spite of the non-uniformity of driving TFTs.

However, such a driving method is problematic in that a lot of time is required until the current of the OLED becomes stable when a low current is driven. This problem becomes more serious as the size of a panel increases, and as the parasitic resistance and capacitance of lines constituting a pixel increase, thus it is well known that the use of such a current driving scheme is very difficult in a large-sized panel.

FIG. 1 is a circuit diagram showing an example of a current feedback OLED driving circuit, in which the above-described voltage driving and current driving are appropriately combined with each other (U.S. Pat. No. 6,433,488).

The operation of this driving circuit is described in brief below.

First, in a pixel circuit, a driving TFT T1 is connected in series with the OLED, and switching TFTs T2 to T4 are provided.

If a scan signal Scan becomes high and a specific pixel is selected, the TFTs T2 and T3 are turned on, and OLED current is programmed.

The time for which a single pixel is selected is determined by the size of a panel and the number of frames per second.

If the scan time for a specific pixel is terminated, the scan signal selects a subsequent pixel, the TFTs T2 and T3 are turned off, and the TFT T4 is turned on, so that previously programmed OLED current flows from a power source Vs until a subsequent programming time arrives.

The driving circuit part of FIG. 1 includes a current mirror composed of PMOS transistors P1 and P2 for mirroring reference current Iref, which is determined using a circuit (not shown) for converting digital graphic data into current, a current mirror composed of PMOS transistors P3 and P4 for mirroring current $I_{OLED}$, which flows through the OLED, a current comparator composed of NMOS transistors N1 and N2 for comparing the two currents with each other, and an amplifier N3 for amplifying the result of current comparison.

If $I_{OLED}$<Iref when the scan signal is high, that is, in a programming time, the driving circuit is operated so that the output of the current comparator, that is, the voltage at the drain of the transistor N2, decreases, the output of the driving circuit, that is, the voltage at the drain of the transistor N3, increases, and the voltage at the gate of the pixel driving TFT T1 increases, thus the OLED current increases.

In contrast, if $I_{OLED}$>Iref, the driving circuit is operated so that voltage at the gate of the driving TFT T1 decreases, thus the OLED current decreases. The object of the circuit is to operate such that $I_{OLED}$=Iref is satisfied through such a negative feedback operation.

However, this circuit includes two lines for connecting the driving circuit to the pixel circuit. That is, the lines are the data line (Data line) and scan line (Sense line) of FIG. 1. For the two lines, the driver IC requires two pads per column (channel).

Recently, there is a tendency for the width of each column driver circuit to become less than that of the pad in order to reduce the cost of a driver IC, thus the width of the pad determines the actual area of the driving circuit.

Therefore, when two pads are used in a single column driver, as shown in the circuit of FIG. 1, the area of the driver IC increases, thus greatly decreasing price competitiveness.

SUMMARY OF THE INVENTION

Accordingly, the present invention has been made keeping in mind the above problems occurring in the prior art, and an object of the present invention is to provide a current feedback-type AMOLED driving circuit, in which a single data line is provided per column, two adjacent columns are paired, and an odd-numbered column and an even-numbered column are temporally separately driven to program current so that, if an odd-numbered column is driven, a data line for an even-numbered column is used as a current feedback line for the odd-numbered column, whereas, if an even-numbered column is driven, a data line for an odd-numbered column is used as a current feedback line for the even-numbered column, thus limiting the number of pads of the driver IC to one per column, and consequently improving price competitiveness.

In order to accomplish the above object, the present invention provides a current feedback-type Active Matrix Organic Light Emitting Diode (AMOLED) driving circuit in a current feedback-type AMOLED flat panel display device, comprising a plurality of pixel circuits each having a data terminal for receiving a pixel current command, and a sense terminal for transmitting pixel current to a driver Integrated Circuit (IC); and a plurality of data lines provided such that a single data line is provided for a single column formed by a plurality of pixel circuits, thus data terminals of the pixel circuits, forming the column, are connected to the data line, wherein the AMOLED driving circuit is constructed such that two columns are paired, sense terminals of pixel circuits, forming a first column of the two columns, are connected to a data line for a second column, and sense terminals of pixel circuits, forming the second column, are connected to the data line for the first column, so that the first and second columns are temporally separately driven to program current, and wherein the AMOLED driving circuit is operated such that, when the first column is driven, the data line for the second column is used as a current feedback line for the first column, and when the second column is driven, the data line for the first column is used as a current feedback line for the second column.

Preferably, the two columns may be adjacent columns or columns for realizing the same color.

Preferably, the current feedback-type AMOLED driving circuit may further comprise a switching unit between the driver IC and the data lines for the two columns, the switching unit connecting a data line for a column, to which current is to be programmed, to a data terminal of the driver IC, and connecting a data line, to be used as a feedback line, to a sense terminal of the driver IC, thus alternately connecting the data lines to the driver IC depending on functions of paired data lines.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings. However, the following embodiments are only used to illustrate the present invention, and are not intended to limit the present invention.

Figure 1:
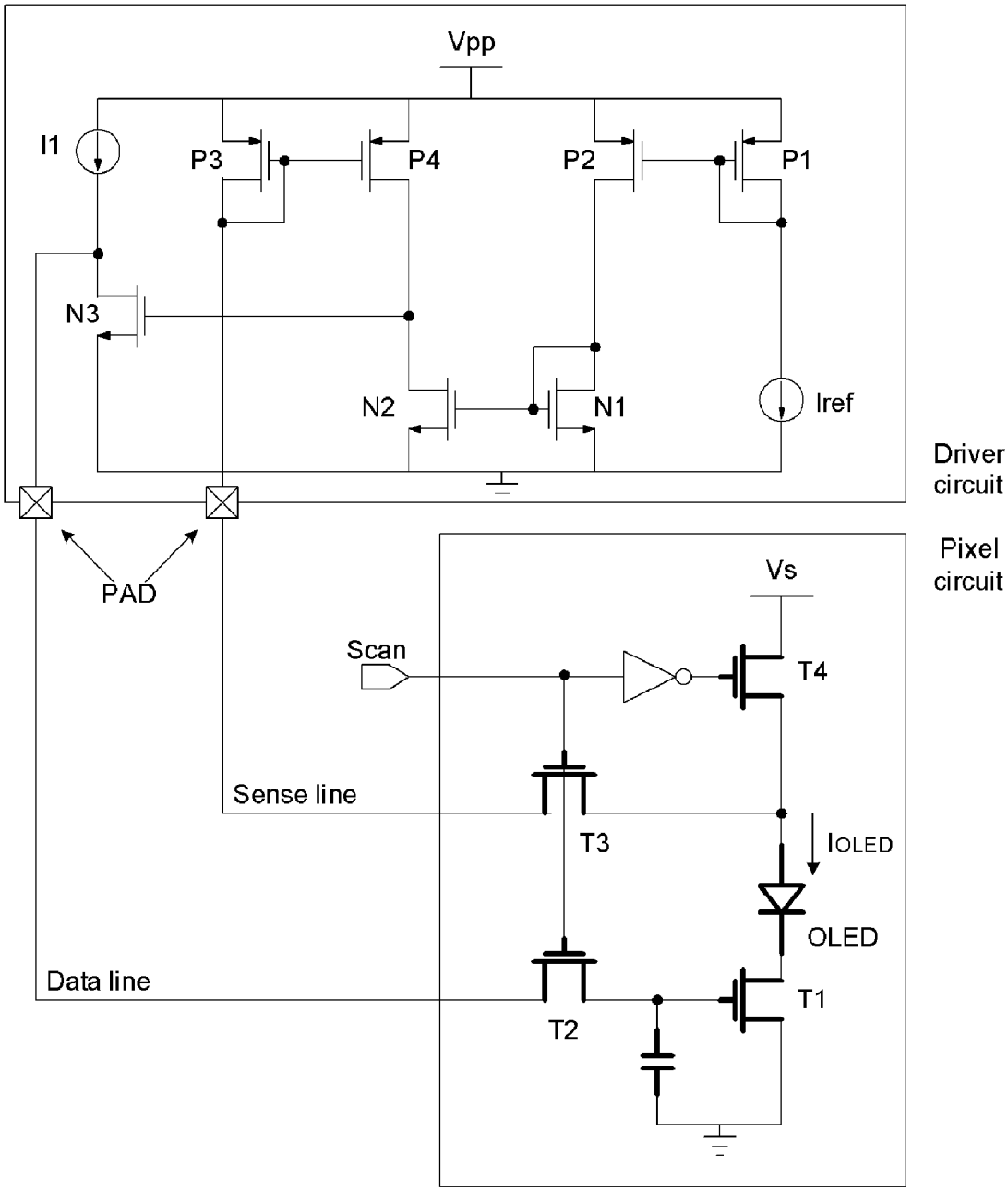
FIG. 1 is a circuit diagram showing a conventional current feedback-type AMOLED driving circuit.
Figure 2:
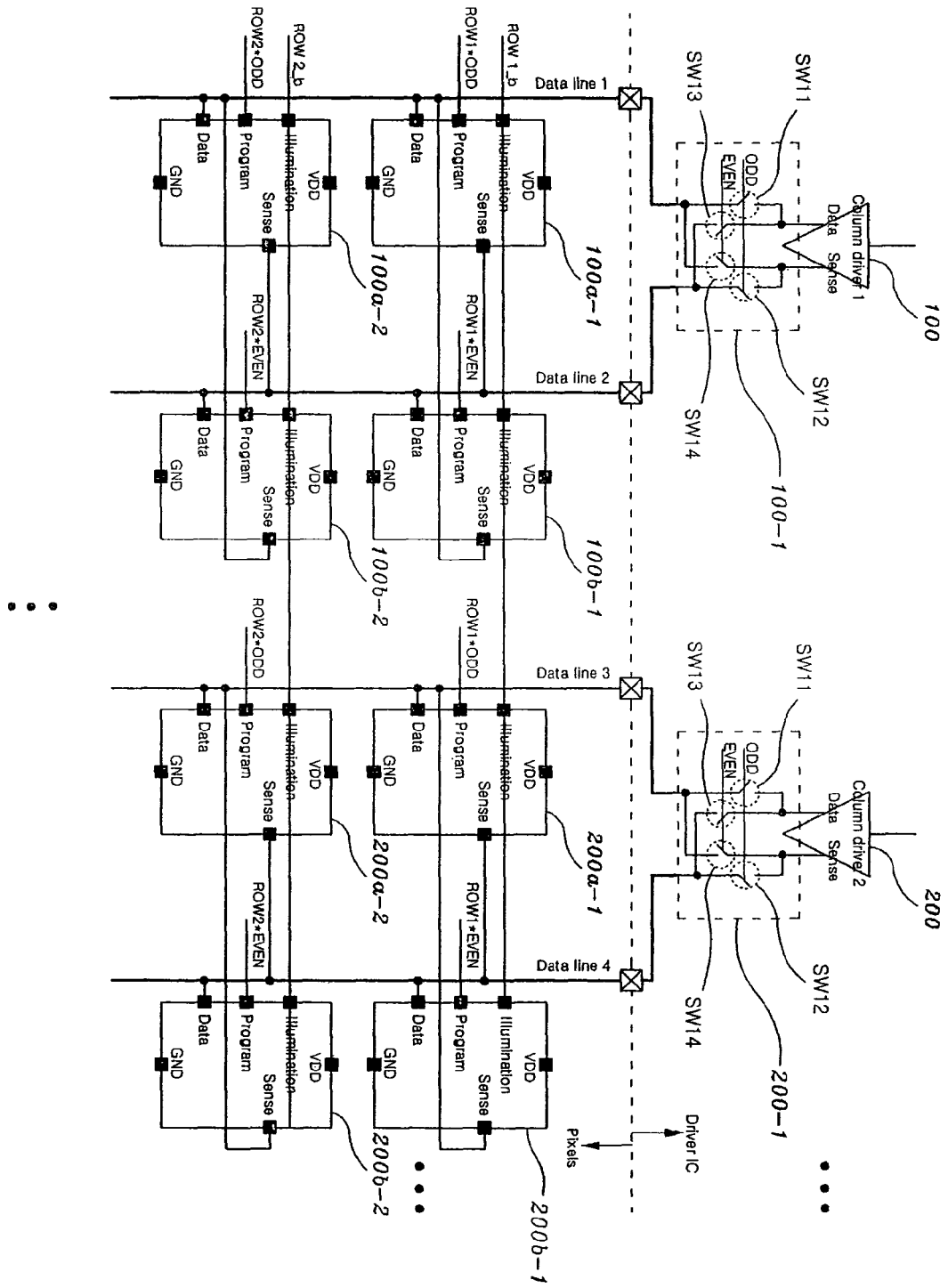
FIG. 2 is a circuit diagram showing a current feedback-type AMOLED driving circuit according to the present invention.

FIG. 2 is a circuit diagram showing a current feedback-type AMOLED driving circuit according to the present invention.

As shown in the drawing, column drivers 100 and 200 are connected to pixel circuits 100*a*-1, 100*a*-2, 100*b*-1, 100*b*-2, 200*a*-1, 200*a*-2, 200*b*-1, and 200*b*-2, each having a data terminal Data for receiving a pixel current command, and a sense terminal Sense, which is an output terminal for transmitting pixel current to the column driver 100 or 200, through data lines Data line1 to Data line4.

In this case, the pixel circuits 100*a*-1 and 100*a*-2, forming an odd-numbered column, and the pixel circuits 100*b*-1 and 100*b*-2, forming an even-numbered column, can be connected to the data terminal Data and the sense terminal Sense of the column driver 100 through a single data line Data line1 and a single data line Data line2, respectively.

Further, the driving circuit is constructed so that a switching unit 100-1, composed of a plurality of switches SW11 to SW14, is interposed between the data line Data line1 for connecting the column driver 100 to the pixel circuits 100*a*-1 and 100*a*-2, forming an odd-numbered column, and the data line Data line2 for connecting the column driver 100 to the pixel circuits 100*b*-*i* and 100*b*-2, forming an even-numbered column. Accordingly, when the odd-numbered column is driven, the data line Data line2 for the even-numbered column is used as a sense line (or current feedback line) for the odd-numbered column, whereas, when the even-numbered column is driven, the data line Data line1 for the odd-numbered column is used as a sense line for the even-numbered column.

Similar to this, the column driver 200 is constructed so that pixel circuits 200*a*-1 and 200*a*-2, forming an odd-numbered column, and the pixel circuits 200*b*-1 and 200*b*-2, forming an even-numbered column, can be connected to the data terminal Data and the sense terminal Sense of the column driver 200 through a single data line Data line3 and a single data line Data line4, respectively.

Further, the driving circuit is constructed so that a switching unit 200-1 composed of a plurality of switches SW11 to SW14 is interposed between the data line Data line3 for connecting the column driver 200 to the pixel circuits 200*a*-1 and 200*a*-2, forming an odd-numbered column, and the data line Data line4 for connecting the column driver 200 to the pixel circuits 200*b*-1 and 200*b*-2, forming an even-numbered column. Accordingly, when the odd-numbered column is driven, the data line Data line4 for the even-numbered column is used as a sense line for the odd-numbered column, whereas, when the even-numbered column is driven, the data line Data line3 for the odd-numbered column is used as a sense line for the even-numbered column.

In the above description, only two column drivers 100 and 200 are described, but it is apparent that the number of column drivers can be expanded, and that the number of pixel circuits can also be expanded.

The present invention having the above construction is described with reference to the timing diagram of FIG. 3.

Each of the column drivers 100 and 200 is a circuit for receiving digital data corresponding to graphic data, and driving a selected pixel using a current value corresponding to the graphic data, and is a current feedback-type AMOLED driving circuit. Each of the column drivers 100 and 200 applies a current command corresponding to input data to a pixel through the data terminal Data, and receives the current of the pixel as a feedback input through the sense terminal Sense, thus the pixel current is driven to a value equal to the input current value.

Each of the pixel circuits 100*a*-1, 100*a*-2, 100*b*-1, 100*b*-2, 200*a*-1, 200*a*-2, 200*b*-1, and 200*b*-2, forming odd-numbered and even-numbered columns, receives a current command from the column driver 100 or 200, which is a driver circuit, through the data terminal Data thereof, and transmits current, currently flowing through a pixel, to the column driver 100 or 200 through the sense terminal Sense thereof.

Further, if a high signal is externally input to the program terminal Program of each of the pixel circuits 100*a*-1, 100*a*-2, 100*b*-1, 100*b*-2, 200*a*-1, 200*a*-2, 200*b*-1 and 200*b*-2 for receiving a current program control signal, desired current is programmed through the column driver 100 or 200. If a high signal is input to an illumination terminal Illumination for receiving an illumination control signal, light having a certain brightness is emitted while previously programmed current continuously flows through the pixel circuit. Current flows into the pixel circuit from a power terminal VDD, and flows out of the pixel circuit through a ground terminal GND.

Meanwhile, in the case where a row signal ROWk, which is a row select signal, becomes high, and current is programmed to a corresponding row (k-th row), if a control signal ODD, required to select a pixel in an odd-numbered column, is high, a pixel in an odd-numbered column is selected, whereas, if a control signal EVEN, required to select a pixel in an even-numbered column, is high, a pixel in an even-numbered column is selected. In FIG. 2, character*in ROWk*ODD denotes a logical product.

In relation to this operation, the pixel circuits 100*a*-1, 100*a*-2, 100*b*-1 and 100*b*-2, which are connected to the column driver 100 through the data lines Data line1 and Data line2, and form odd-numbered and even-numbered columns, are described as an example. The pixel circuits 200*a*-1, 200*a*-2, 200*b*-1 and 200*b*-2, which are connected to the column driver 200 through the data lines Data line3 and Data line4 and form odd-numbered and even-numbered columns, are also operated using the same method.

Case where a Row Signal ROW1, which is a Row Select Signal, is High

First, if a control signal ODD required to select a pixel in an odd-numbered column is high, an odd-numbered data line Data line1 connects the data input of the data terminal Data of the pixel circuit 100*a*-1 in an odd-numbered column to the data output of the data terminal Data of the column driver 100 through the switch SW11 of the switching unit 100-1.

Further, the even-numbered data line Data line2 connects the sense output of the sense terminal Sense of the pixel circuit 100*a*-1 in an odd-numbered column to the sense input of the sense terminal Sense of the column driver 100 through the switch SW12 of the switching unit 100-1.

Then, if a control signal EVEN, required to select a pixel in an even-numbered column, is high, the even-numbered data line Data line2 connects the data input of the data terminal Data of the pixel circuit 100*b*-1 in an even-numbered column to the data output of the data terminal Data of the column driver 100 through the switch SW13 of the switching unit 100-1.

Further, the odd-numbered data line Data line1 connects the sense output of the sense terminal Sense of the pixel circuit 100*a*-1 in the odd-numbered column to the sense input of the sense terminal Sense of the column driver 100 through the switch SWl4 of the switching unit 100-1.

If the row signal ROW1, that is, the row select signal, is high, the above procedure is simultaneously performed on all pairs of odd-numbered and even-numbered pixels 200*a*-1 and 200*b*-1, etc. connected to the first row. If a row signal ROW2 becomes high, the procedure is repeated on all pairs of odd-numbered and even-numbered pixels connected to a second row.

If one of two adjacent columns uses a data line for the other column as a feedback line or sense line of pixel current in turn in this way, the current feedback-type AMOLED driving circuit can be implemented while a single pad per column of the driver IC is maintained.

Figure 3:
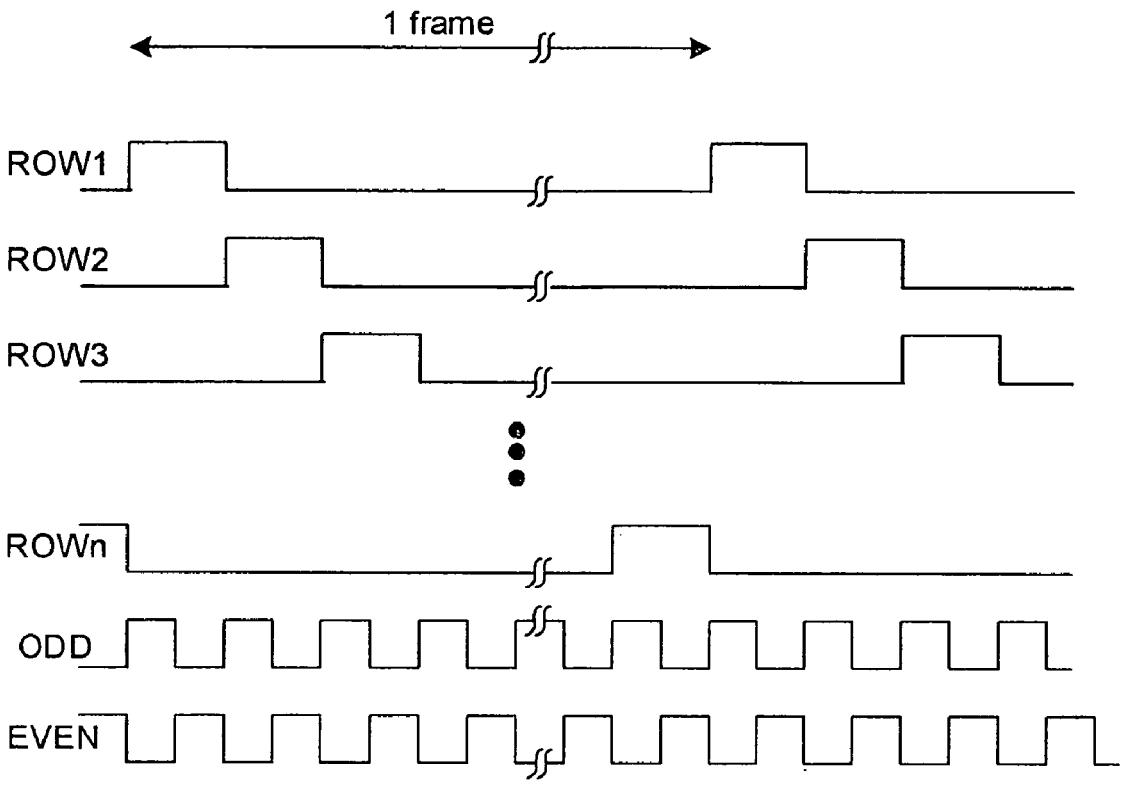
FIG. 3 is a timing diagram of the driving circuit according to the present invention.

FIGS. 4A to 4D are circuit diagrams showing various embodiments of the pixel circuit of FIG. 3.

Figure 4A:
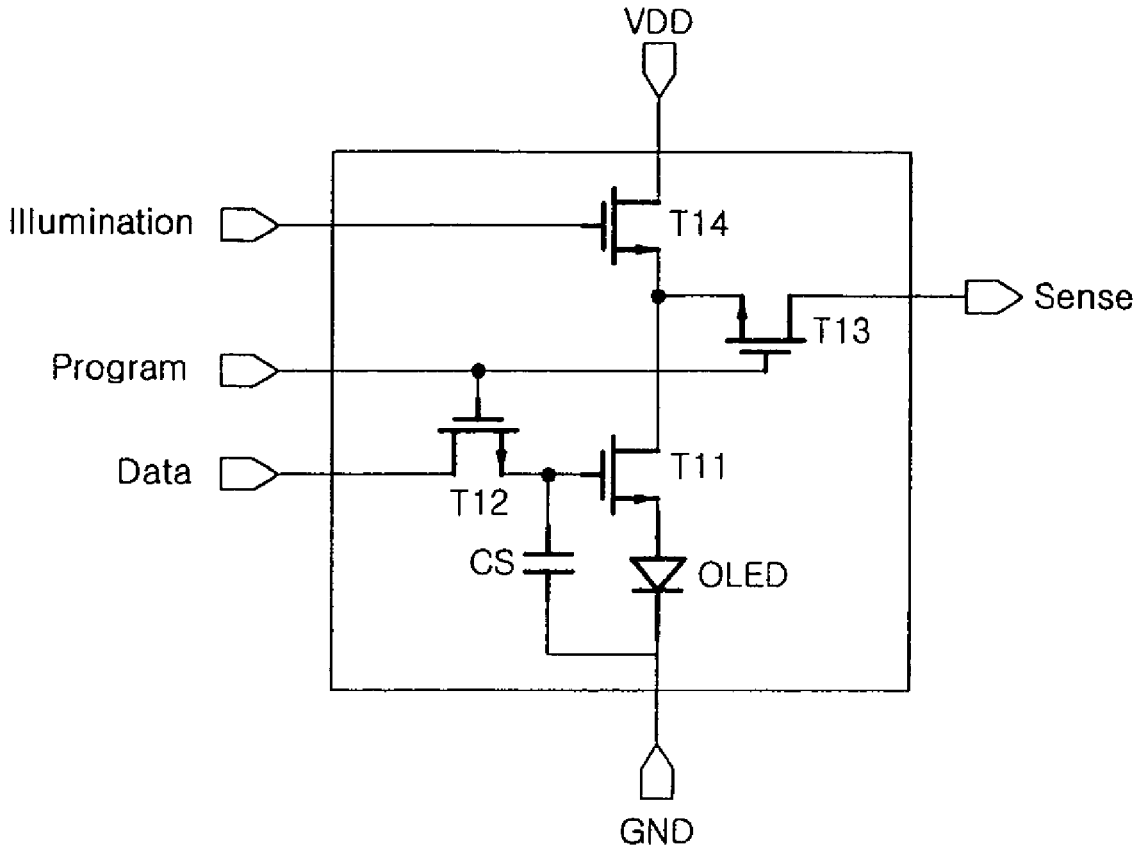
FIGS. 4A to 4D are circuit diagrams showing various embodiments of a pixel circuit used in the driving circuit of FIG. 2.

FIG. 4A illustrates an embodiment in which the source terminal of a driving transistor T11 is connected to the anode terminal of an OLED, the cathode terminal of which is connected to ground, the gate terminal and the drain terminal of the driving transistor T11 are respectively connected to the source terminals of N-type switching transistors T12 and T13, which are each turned on when a current program control signal received through a program terminal Program is high, and the drain terminal of the transistor T13 is connected to the sense terminal Sense.

Further, the drain terminal of the driving transistor T11 is connected to the source terminal of an N-type switching transistor T14, which is turned on to enable the flow of current from a power terminal VDD when an illumination control signal, input from an illumination terminal Illumination for receiving a signal operating opposite the signal input to the program terminal Program, is high. A storage capacitor Cs is connected in parallel between the gate terminal of the driving transistor T11 and the cathode terminal of the OLED. This structure is described using the pixel circuit 100*a*-1 as an example.

First, when a current program control signal input from the program terminal Program is high, the data output of the driver IC, that is, the column driver 100, is applied to the gate of the driving transistor T11 through the data line Data Line1 and the data terminal Data, and drain current of the driving transistor T11 is transferred to the column driver 100 as a sense input through the data line Data Line2.

If current programming is terminated, the gate voltage of the driving transistor T11 is stored and maintained in the storage capacitor Cs, and pixel current constantly flows from the power terminal VDD until subsequent programming starts.

Figure 4B:
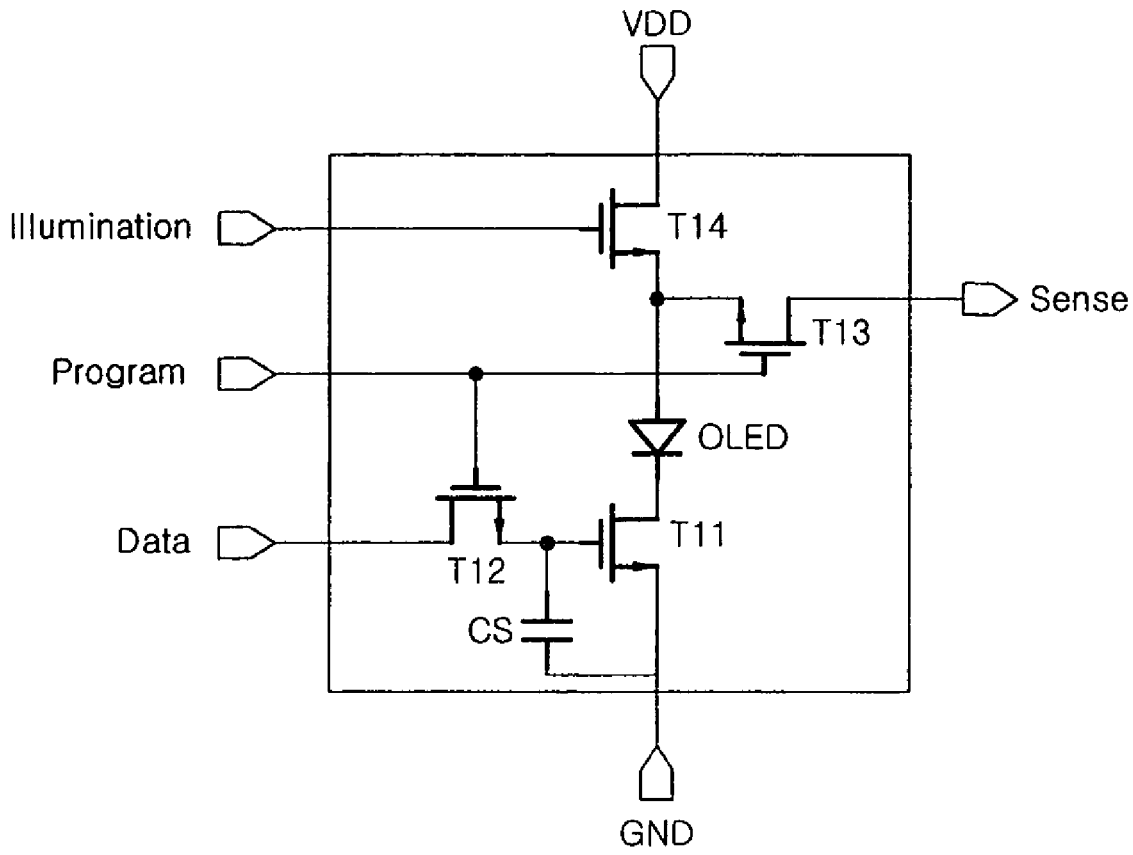
Figure 4C:
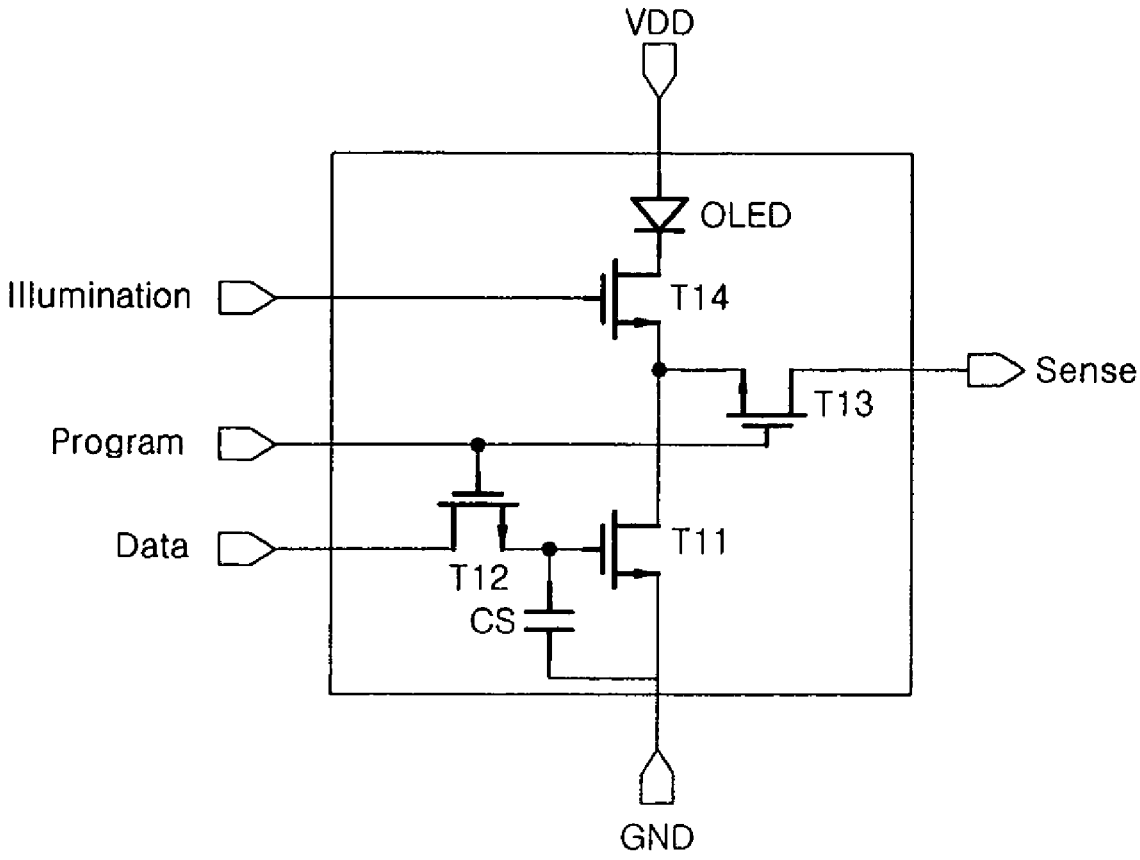
Figure 4D:
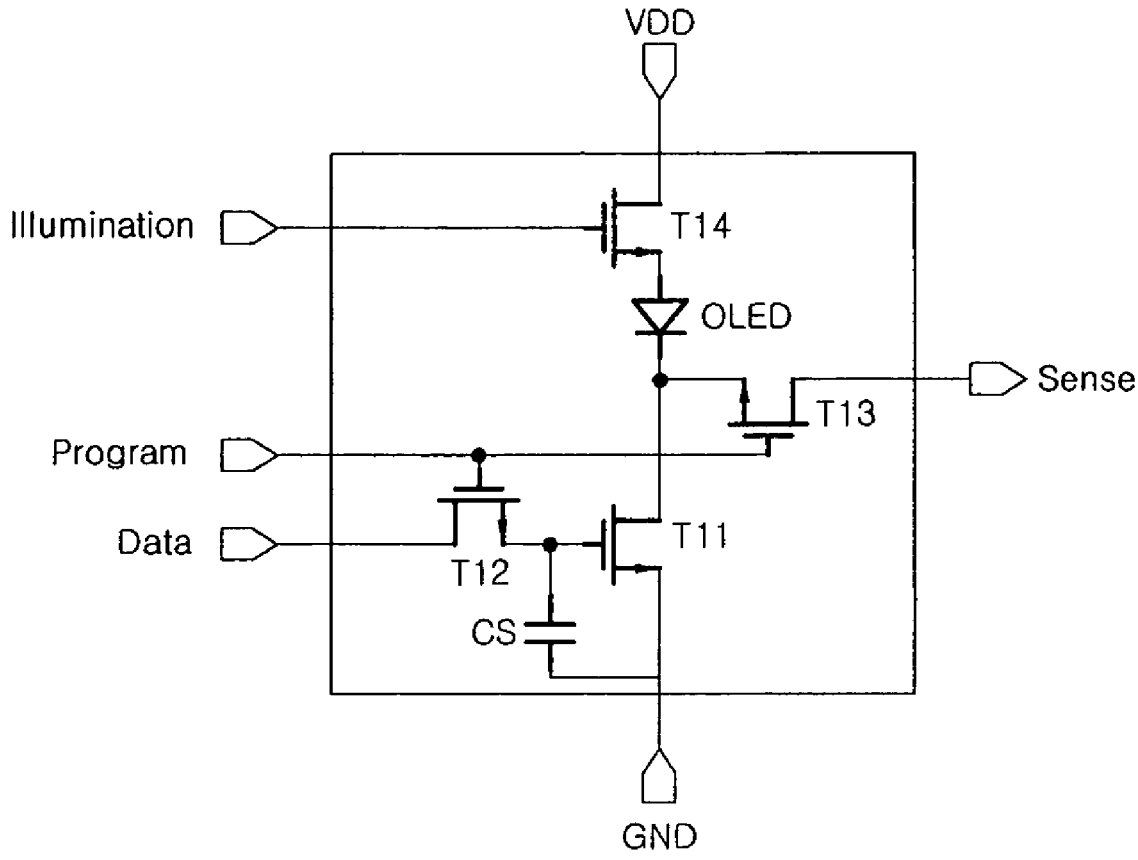

FIGS. 4B to 4D illustrates embodiments in which the location of an OLED is changed, unlike the embodiment of FIG. 4A. FIG. 4B illustrates a structure in which the cathode terminal of the OLED is connected to the drain terminal of a driving transistor T11, and the anode terminal of the OLED is connected to the source terminals of transistors T13 and T14. FIG. 4C illustrates a structure in which the cathode of an OLED is connected to the drain terminal of the transistor T14, and the anode of the OLED is connected to a power terminal VDD. FIG. 4D illustrates a structure in which the cathode of an OLED is connected both to the drain terminal of the driving transistor T11 and the source terminal of the transistor T13, and the anode of the OLED is connected to the source terminal of the transistor T14. The operations thereof can be understood from FIG. 4A, so a detailed description thereof is omitted.

Figure 5:
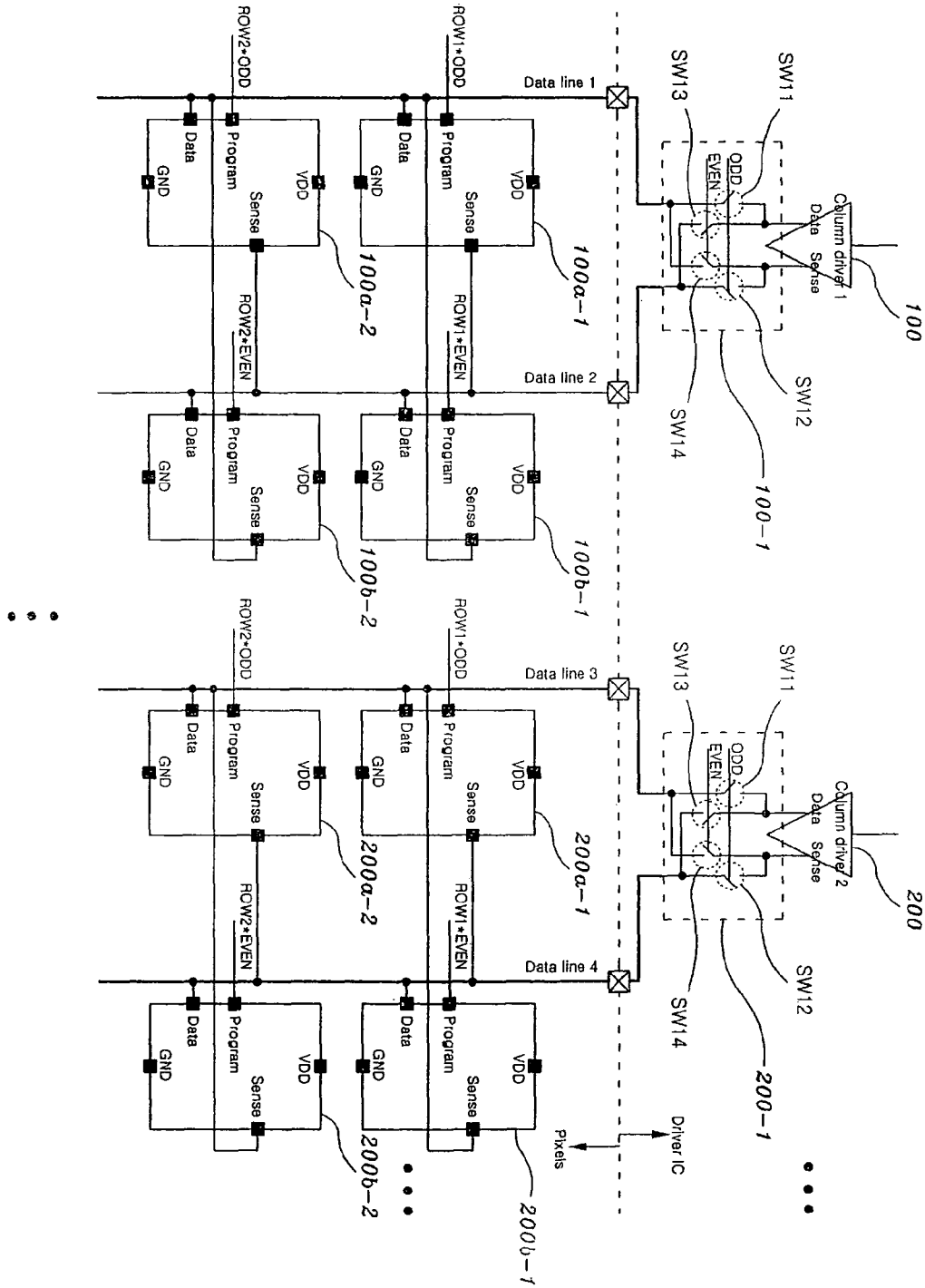
FIG. 5 is a circuit diagram showing a current feedback-type AMOLED driving circuit according to another embodiment of the present invention.

FIG. 5 is a circuit diagram showing a current feedback-type AMOLED driving circuit according to another embodiment of the present invention, and shows the case where an illumination terminal Illumination is not required, unlike the embodiment of FIG. 2.

The circuit of FIG. 5 is operated so that pixel circuits 100*a*-1, 100*a*-2, 100*b*-1, 100*b*-2, 200*a*-1, 200*a*-2, 200*b*-1, and 200*b*-2 in corresponding odd-numbered columns and even-numbered columns are operated in response to a control signal ROW1*ODD or ROW2*ODD, required to select a pixel in an odd-numbered column, and a control signal ROW1*EVEN or ROW2*EVEN, required to select a pixel in an even-numbered column in the embodiment of FIG. 2. This operation is the same as that of the embodiment of FIG. 2, so a detailed description thereof is omitted.

FIGS. 6A to 6E are circuit diagrams showing various embodiments of the pixel circuit of FIG. 5, and shows the case where an illumination terminal Illumination for receiving an illumination control signal is not necessary, unlike the case of FIG. 4.

Figure 6A:
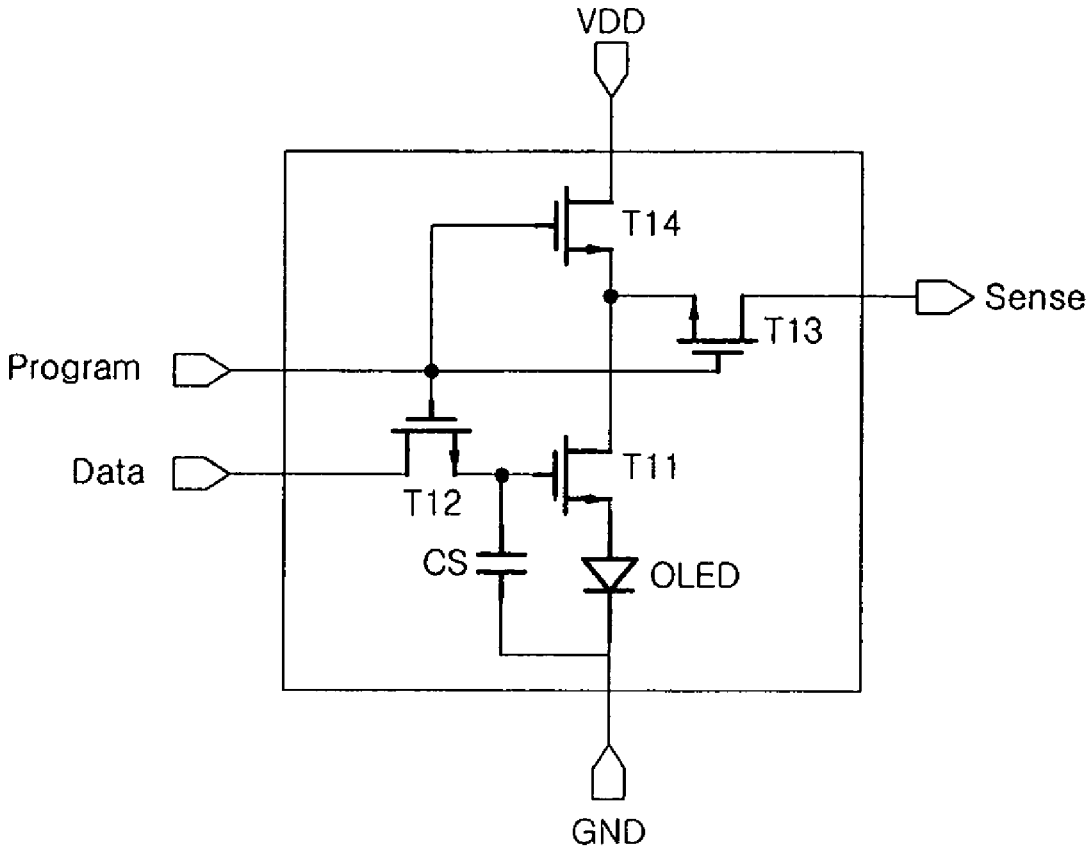
FIGS. 6A to 6E are circuit diagrams showing various embodiments of a pixel circuit used in the driving circuit of FIG. 5.

FIG. 6A illustrates a structure in which the anode of an OLED, the cathode of which is connected to the ground, is connected to the source terminal of a driving transistor T11, the gate terminal and the drain terminal of the driving transistor T11 are respectively connected to the source terminals of N-type switching transistors T12 and T13, which are each turned on when a current program control signal input from a program terminal Program is high, and the drain terminal of the transistor T13 is connected to a sense terminal Sense.

Further, the pixel circuit of FIG. 6A includes a P-type switching transistor T14, the source terminal of which is connected to a power terminal VDD, the drain terminal of which is connected both to the drain terminal of the driving transistor T11 and to the source terminal of the transistor T13, and the gate terminal of which is connected to the program terminal Program to receive the current program control signal therefrom, and which is operated to be turned on when the current program control signal is low. A storage capacitor Cs is connected in parallel between the gate terminal of the driving transistor T11 and the cathode terminal of the OLED.

This structure is only different from the structure of FIG. 4A in that, since the gate terminal of the transistor T14 is connected to the program terminal Program, the circuit is operated in response to the current program control signal received from the program terminal Program. That is, since the transistor T14 is a P-type transistor, the transistor T14 is turned off when the transistors T12 and T13 are turned on, and is turned on when the transistors T12 and T13 are turned off, so that pixel current can constantly flow from the power terminal VDD until subsequent programming starts.

Figure 6B:
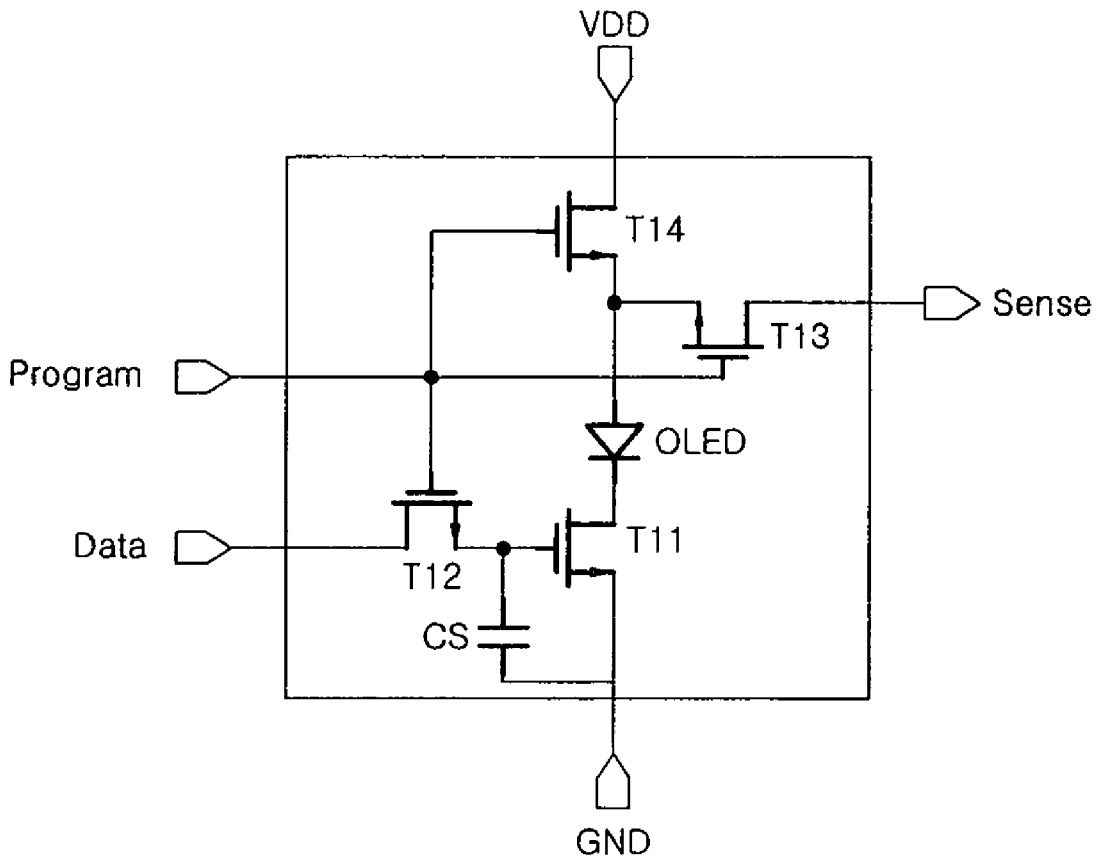
Figure 6C:
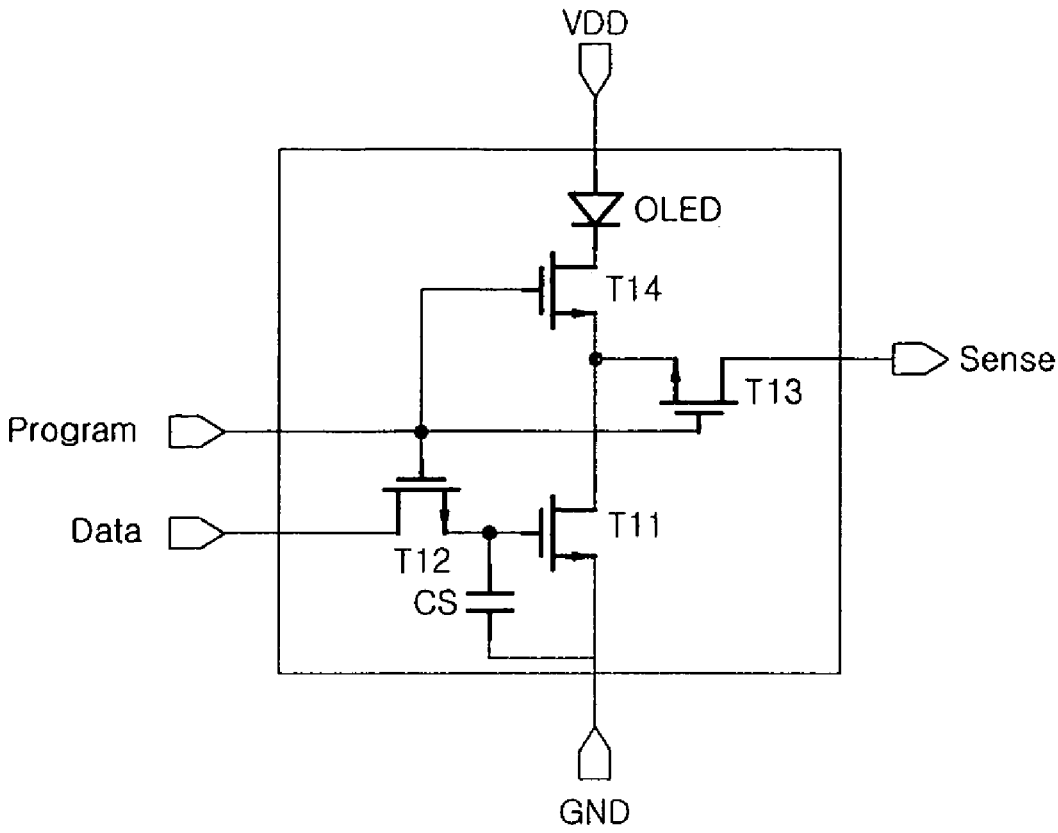
Figure 6D:
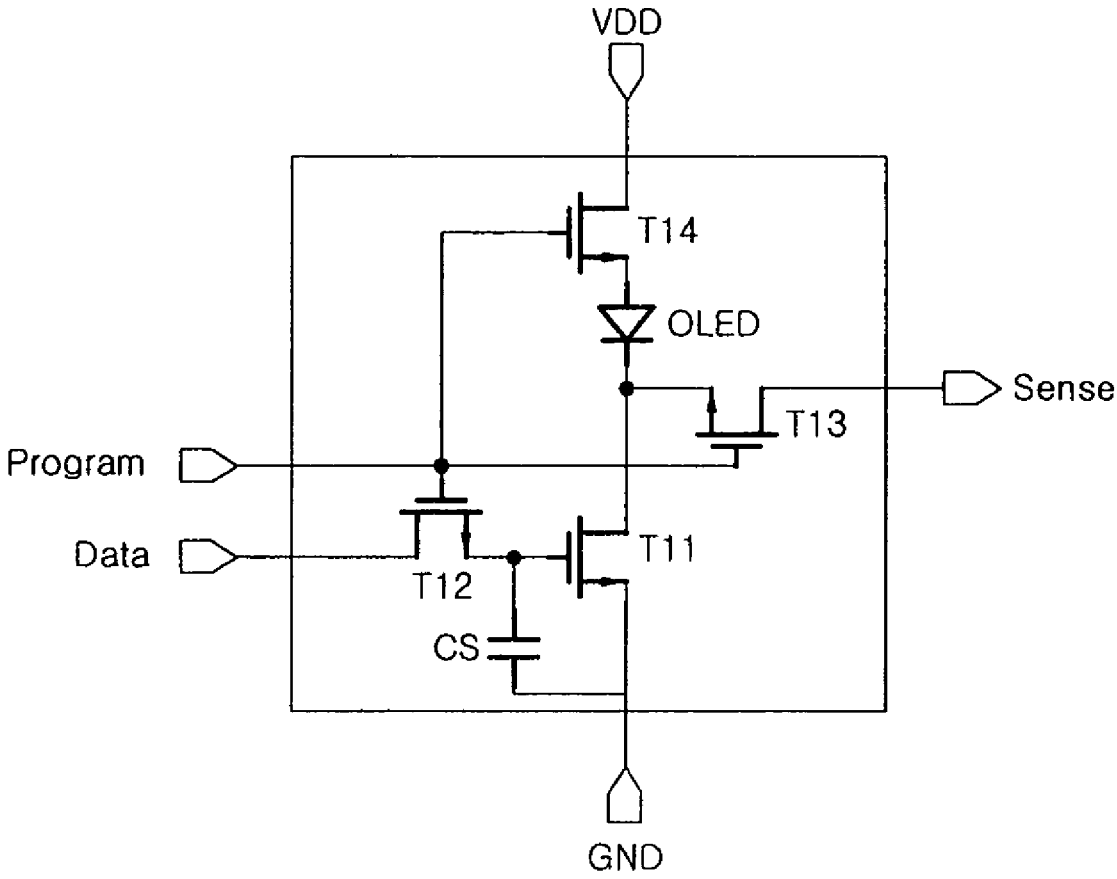

Further, FIG. 6B to FIG. 6D illustrate structures in which the location of an OLED is changed, unlike the structure of FIG. 6A. FIG. 6B illustrates a structure in which the cathode of an OLED is connected to the drain terminal of a driving transistor T11, and the anode of the OLED is connected both to the drain terminal of a transistor T14 and to the source terminal of a transistor T13. FIG. 6C illustrates a structure in which the cathode of the OLED is connected to the source terminal of the transistor T14, and the anode of the OLED is connected to a power terminal VDD. FIG. 6D illustrates a structure in which the cathode of the OLED is connected both to the drain terminal of the driving transistor T11 and to the source terminal of the transistor T13, and the anode of the OLED is connected to the drain terminal of the transistor T14. The operations thereof can be understood from FIG. 6A, so a detailed description thereof is omitted.

Figure 6E:
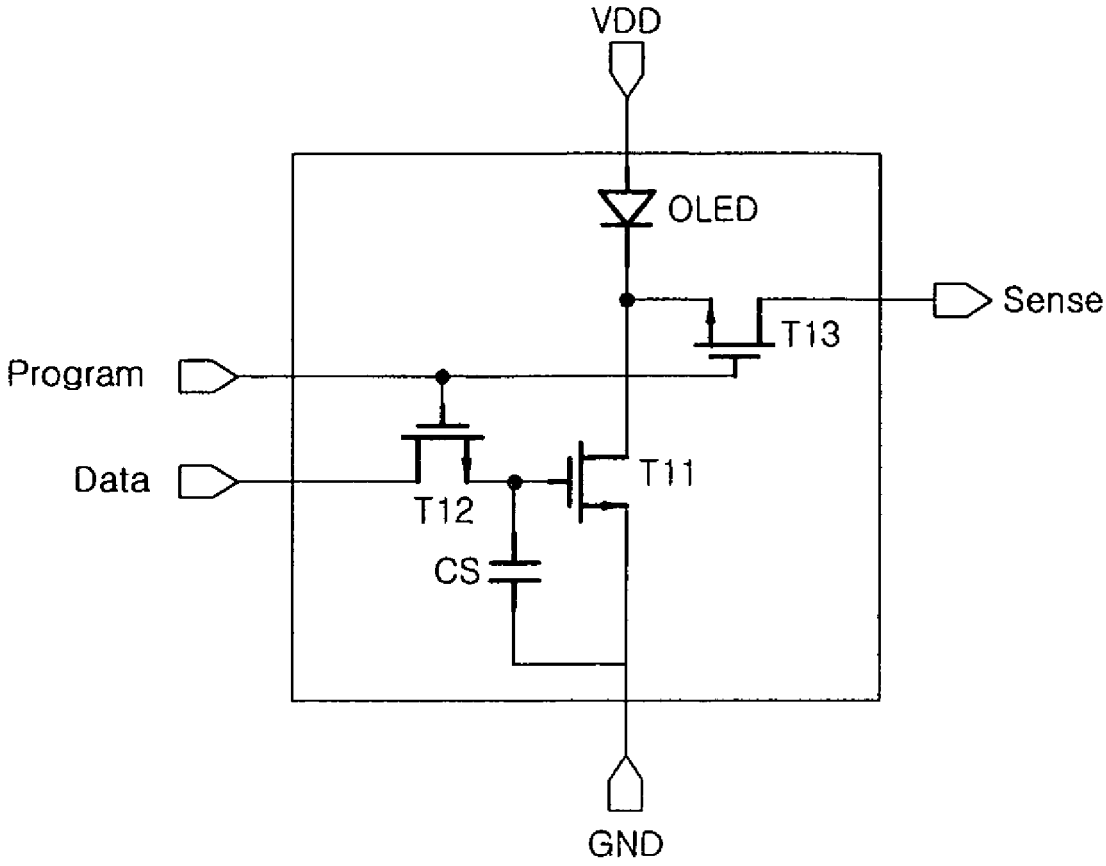

Further, FIG. 6E illustrates the case where the transistor T14 is not included, unlike the cases of FIGS. 6A to 6D, and shows a structure in which the transistor T14 of FIGS. 6A to 6D is not provided, and the cathode of the OLED is connected both to the drain terminal of the driving transistor T11 and to the source terminal of the transistor T13, and the anode of the OLED is connected to the power terminal VDD.

In this structure, voltage output from the sense terminal Sense of the column driver circuit is the voltage at the cathode of the OLED during the programming of pixel current. The structure of FIG. 6E suitably controls such a voltage, thus preventing the OLED from being turned on during the programming operation. In this way, since one TFT switch can be omitted, the aspect ratio of the OLED display can be improved.

Figure 7:
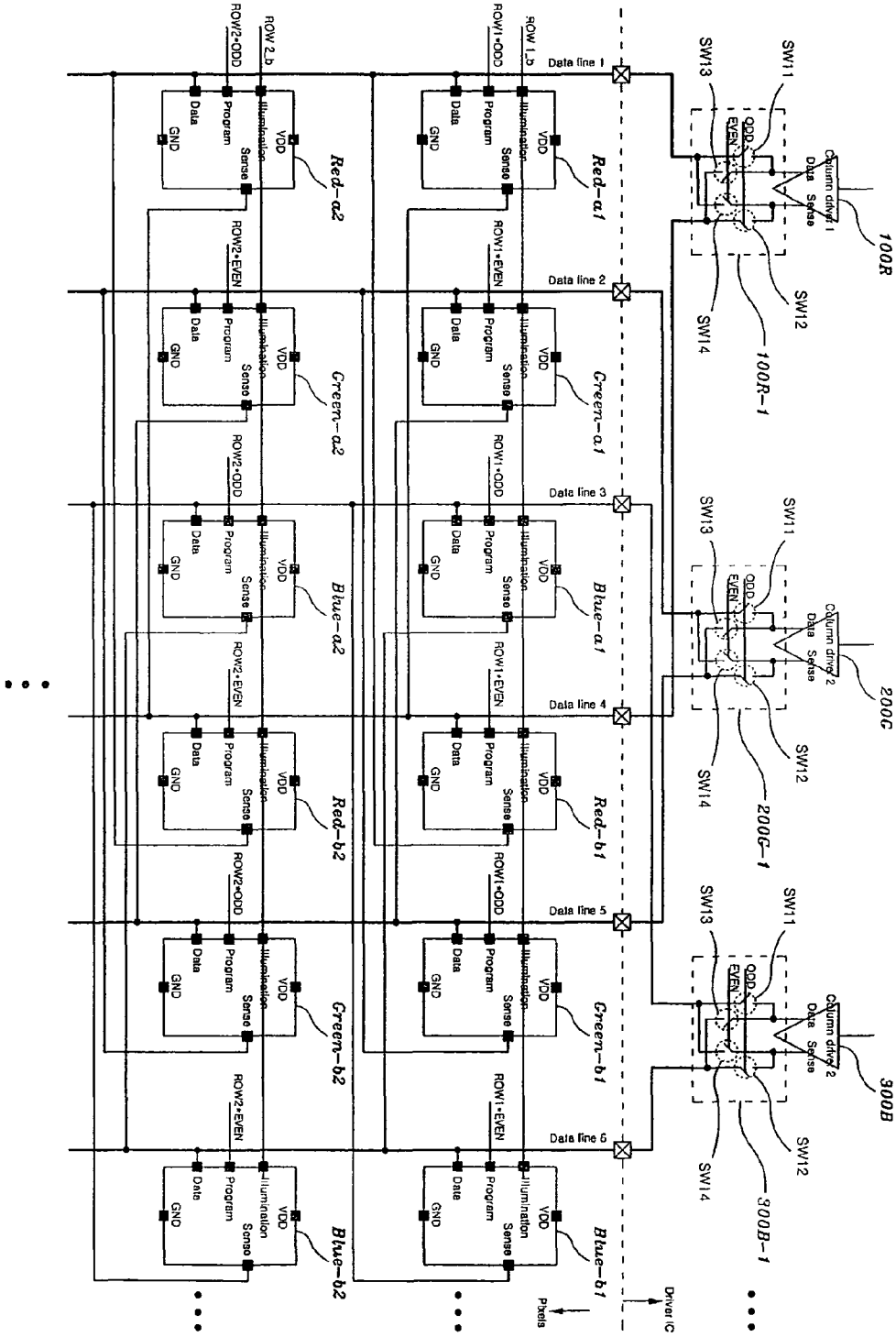
FIGS. 7 and 8 are circuit diagrams showing a current feedback-type AMOLED driving circuit according to other embodiments of the present invention.

FIG. 7 is a circuit diagram showing a current feedback-type AMOLED driving circuit according to a further embodiment of the present invention, and shows the embodiment in which pixels having the same color are paired, unlike the embodiment of FIG. 2.

As shown in FIG. 7, the circuit has a structure in which two red columns formed by a plurality of pixel circuits Red-a1, Red-a2, Red-b1, and Red-b2, which realize a red color, are connected to a single red column driver 100R through a single data line Data Line1 and a single data line Data Line4, respectively, two green columns formed by a plurality of pixel circuits Green-a1, Green-a2, Green-b1, and Green-b2, which realize a green color, are connected to a single green column driver 200G through a single data line Data Line2 and a single data line Data Line5, respectively, and two blue columns formed by a plurality of pixel circuits Blue-a1, Blue-a2, Blue-b1, and Blue-b2, which realize a blue color, are connected to a single blue column driver 300B through a single data line Data Line3 and a single data line Data Line6, respectively.

Further, the AMOLED driving circuit is constructed so that the data line Data line1, connected to the pixel circuits Red-a1 and Red-a2, forming one side red column of the two red columns, and the data line Data Line4, connected to the pixel circuits Red-b1 and Red-b2, forming the other side red column, can be connected to the red column driver 100R through the switching operation of a switching unit 100R-1 composed of a plurality of switches SW11 to SW14, similar to the above embodiment. Accordingly, a data line for a column, to which current is to be programmed, is connected to the data terminal Data of the column driver circuit, and a data line, to be used as a feedback line, is connected to the sense terminal Sense of the column driver circuit, thus the data lines are alternately connected to the column driver circuit depending on the functions of the paired data lines. This operation is equally applied to the green and blue colors.

The operation of the AMOLED driving circuit according to the embodiment is the same as that of the embodiment of FIG. 2, so a detailed description thereof is omitted. Further, the embodiment of FIG. 7 can be implemented using the pixel circuit of FIGS. 4A to 4D.

Figure 8:
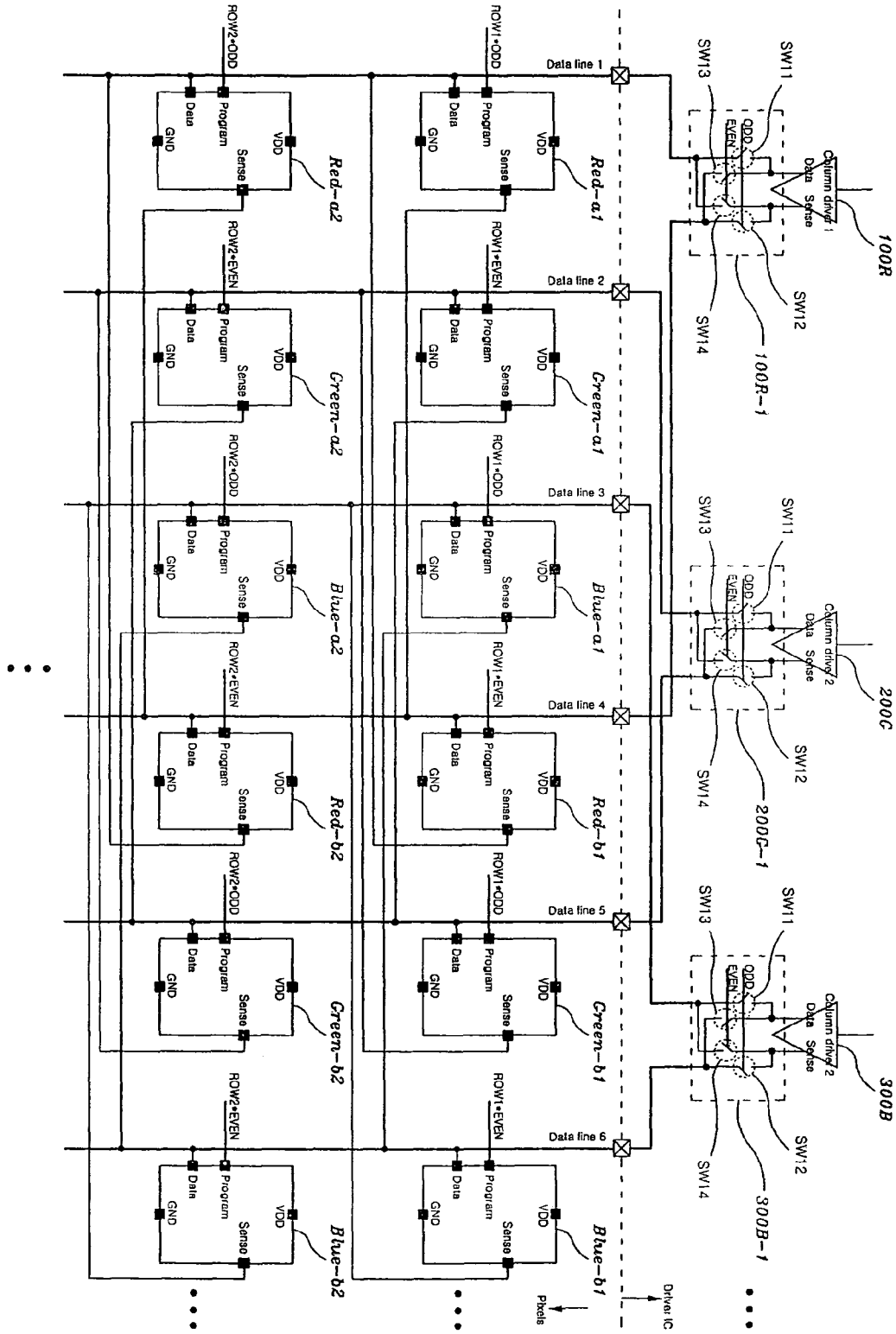

FIG. 8 is a circuit diagram showing yet another embodiment of the present invention, and shows the case where pixels having the same color are paired, similar to the embodiment of FIG. 7, but an illumination terminal Illumination for receiving an illumination control signal is not necessary, similar to the embodiment of FIG. 5. The detailed operation thereof can be understood from the embodiments of FIGS. 7 and 5, so a detailed description thereof is omitted. Further, the embodiment of FIG. 8 can be implemented using the pixel circuits of FIG. 6A to 6E.

When the columns having the same color are paired, as shown in FIGS. 7 and 8, luminance characteristics for the same current differ for different colors, so that an additional correction circuit is not required, thus the area of a driver IC can be reduced, and the manufacturing cost can be decreased. Further, in adjacent columns having the same color, variation in data is small, so high speed driving can be realized.

As described above, the present invention provides a current feedback-type AMOLED driving circuit, in which a single data line is provided for each column, two adjacent columns are paired, and an odd-numbered column and an even-numbered column are temporally separately driven so that, if an odd-numbered column is driven, a data line for an even-numbered column is used as a scan line for the odd-numbered column, whereas, if an even-numbered column is driven, a data line for an odd-numbered column is used as a scan line for the even-numbered column, thus limiting the number of pads of a driver IC to one per column, and consequently improving price competitiveness.

Further, the AMOLED driving circuit is advantageous in that, when columns having the same color are paired, luminance characteristics for the same current differ for different colors, so that an additional correction circuit is not necessary, thus the area of a driver IC can be reduced and the manufacturing cost can be decreased, and in that, in the case of adjacent columns having the same color, variation in data is small, thus high speed driving is possible.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A current feedback-type Active Matrix Organic Light Emitting Diode (AMOLED) driving circuit in a current feedback-type AMOLED flat panel display device, comprising:

a plurality of pixel circuits each having a data terminal for receiving a pixel current command, and a sense terminal for transmitting pixel current to a driver Integrated Circuit (IC); and a plurality of data lines provided such that a single data line is provided for a single column formed by a plurality of pixel circuits, thus data terminals of the pixel circuits, forming the column, are connected to the data line, wherein the AMOLED driving circuit is constructed such that two columns are paired, sense terminals of pixel circuits, forming a first column of the two columns, are connected to a data line for a second column, and sense terminals of pixel circuits, forming the second column, are connected to the data line for the first column, so that the first and second columns are temporally separately driven to program current, and wherein the AMOLED driving circuit is operated such that, when the first column is driven, the data line for the second column is used as a current feedback line for the first column, and when the second column is driven, the data line for the first column is used as a current feedback line for the second column.

2. The current feedback-type AMOLED driving circuit according to claim 1, wherein the two columns are adjacent columns.

3. The current feedback-type AMOLED driving circuit according to claim 1, wherein the two columns are columns for realizing the same color.

4. The current feedback-type AMOLED driving circuit according to claim 2, wherein each of the pixel circuits comprises:

an Organic Light Emitting Diode (OLED) having a cathode connected to ground;

a driving transistor having a source terminal connected to an anode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to a drain terminal of the driving transistor, and a drain terminal connected to the sense terminal, thus the second switching transistor is switched in response to the current program control signal applied to a gate terminal of the second switching transistor;

a third switching transistor having a source terminal connected both to the drain terminal of the driving transistor and to the source terminal of the second switching transistor, and having a drain terminal connected to a power terminal, so that the third switching transistor is switched in response to an illumination control signal, which is applied to a gate terminal of the third switching transistor and performs a control operation to cause previously programmed current to continuously flow; and a storage capacitor connected in parallel between the gate terminal of the driving transistor and the cathode of the OLED.

5. The current feedback-type AMOLED driving circuit according to claim 2, wherein each of the pixel circuits comprises:

an OLED;

a driving transistor having a drain terminal connected to a cathode of the OLED, and a source terminal connected to ground;

a first switching transistor having a source terminal connected to a gate terminal of the driving transistor, and having a drain terminal connected to the data terminal, thus the first switching transistor is switched in response to a current program control signal applied to a gate terminal of the first switching transistor;

a second switching transistor having a source terminal connected to an anode of the OLED, and a drain terminal connected to the sense terminal, thus the second switching transistor is switched in response to the current program control signal applied to a gate terminal of the second switching transistor;

a third switching transistor having a source terminal connected both to the anode of the OLED and the source terminal of the second switching transistor, and having a drain terminal connected to a power terminal, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

6. The current feedback-type AMOLED driving circuit according to claim 2, wherein each of the pixel circuits comprises:

an OLED having an anode connected to a power terminal;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to a drain terminal of the driving transistor, and a drain terminal connected to the sense terminal, thus the second switching transistor is switched in response to the current program control signal applied to a gate terminal of the second switching transistor;

a third switching transistor having a source terminal connected both to the drain terminal of the driving transistor and to the source terminal of the second switching transistor, and having a drain terminal connected to a cathode of the OLED, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

7. The current feedback-type AMOLED driving circuit according to claim 2, wherein each of the pixel circuits comprises:

an OLED;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to a cathode of the OLED, and having a drain terminal connected to the sense terminal, thus the second switching transistor is switched in response to the current program control signal applied to a gate terminal of the second switching transistor;

a third switching transistor having a source terminal connected to an anode of the OLED, and a drain terminal connected to a power terminal, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

8. The current feedback-type AMOLED driving circuit according to claim 2, wherein each of the pixel circuits comprises:

an OLED having a cathode connected to ground;

a driving transistor having a source terminal connected to an anode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to the drain terminal of the driving transistor, and a drain terminal connected to the sense terminal, thus the second switching transistor is switched in response to the current program control signal applied to a gate terminal of the second switching transistor;

a third switching transistor having a drain terminal connected both to the drain terminal of the driving transistor and to the source terminal of the second switching transistor, and having a source terminal connected to a power terminal, thus the third switching transistor is switched in response to the current program control signal applied to a gate terminal of the third switching transistor; and a storage capacitor connected in parallel between the gate terminal of the driving transistor and the cathode of the OLED.

9. The current feedback-type AMOLED driving circuit according to claim 2, wherein each of the pixel circuits comprises:

an OLED;

a driving transistor having a drain terminal connected to a cathode of the OLED, and a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to an anode of the OLED, and a drain terminal connected to the sense terminal, thus the second switching transistor is switched in response to the current program control signal applied to a gate terminal of the second switching transistor;

a third switching transistor having a drain terminal connected both to an anode of the OLED and to the source terminal of the second switching transistor, and having a source terminal connected to a power terminal, thus the third switching transistor is switched in response to the current program control signal applied to a gate terminal of the third switching transistor; and a storage capacitor connected in parallel between the gate terminal and the source terminal of the driving transistor.

10. The current feedback-type AMOLED driving circuit according to claim 2, wherein each of the pixel circuits comprises:

an OLED having an anode connected to a power terminal;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to the drain terminal of the driving transistor, and a drain terminal connected to the sense terminal, thus the second switching transistor is switched in response to the current program control signal applied to a gate terminal of the second switching transistor;

a third switching transistor having a drain terminal connected both to the drain terminal of the driving transistor and to the source terminal of the second switching transistor, and having a source terminal connected to a cathode of the OLED, thus the third switching transistor is switched in response to the current program control signal applied to a gate terminal of the third switching transistor; and a storage capacitor connected in parallel between the gate terminal and the source terminal of the driving transistor.

11. The current feedback-type AMOLED driving circuit according to claim 2, wherein each of the pixel circuits comprises:

an OLED;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to a cathode of the OLED, and having a drain terminal connected to the sense terminal, thus the second switching transistor is switched in response to the current program control signal applied to a gate terminal of the second switching transistor;

a third switching transistor having a drain terminal connected to an anode of the OLED, and a source terminal connected to a power terminal, thus the third switching transistor is switched in response to the current program control signal applied to a gate terminal of the third switching transistor; and a storage capacitor connected in parallel between the gate terminal and the source terminal of the driving transistor.

12. The current feedback-type AMOLED driving circuit according to claim 2, wherein each of the pixel circuits comprises:

an OLED having an anode connected to a power terminal;

a driving transistor having a source terminal connected to ground, and a drain terminal connected to a cathode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to the cathode of the OLED, and having a drain terminal connected to the sense terminal, thus the second switching transistor is switched in response to the current program control signal applied to a gate terminal of the second switching transistor; and a storage capacitor connected in parallel between the gate terminal and the source terminal of the driving transistor.

13. The current feedback-type AMOLED driving circuit according to claim 2 or 3, further comprising a switching unit between the driver IC and the data lines for the two columns, the switching unit connecting a data line for a column, to which current is to be programmed, to a data terminal of the driver IC, and connecting a data line, to be used as a feedback line, to a sense terminal of the driver IC, thus alternately connecting the data lines to the driver IC depending on functions of paired data lines.

14. The current feedback-type AMOLED driving circuit according to claim 3, wherein each of the pixel circuits comprises:

an Organic Light Emitting Diode (OLED) having a cathode connected to ground;

a driving transistor having a source terminal connected to an anode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to a drain terminal of the driving transistor, and a drain terminal connected to the sense terminal, thus the second switching transistor is switched in response to the current program control signal applied to a gate terminal of the second switching transistor;

a third switching transistor having a source terminal connected both to the drain terminal of the driving transistor and to the source terminal of the second switching transistor, and having a drain terminal connected to a power terminal, so that the third switching transistor is switched in response to an illumination control signal, which is applied to a gate terminal of the third switching transistor and performs a control operation to cause previously programmed current to continuously flow; and a storage capacitor connected in parallel between the gate terminal of the driving transistor and the cathode of the OLED.

15. The current feedback-type AMOLED driving circuit according to claim 3, wherein each of the pixel circuits comprises:

an OLED;

a driving transistor having a drain terminal connected to a cathode of the OLED, and a source terminal connected to ground;

a first switching transistor having a source terminal connected to a gate terminal of the driving transistor, and having a drain terminal connected to the data terminal, thus the first switching transistor is switched in response to a current program control signal applied to a gate terminal of the first switching transistor;

a second switching transistor having a source terminal connected to an anode of the OLED, and a drain terminal connected to the sense terminal, thus the second switching transistor is switched in response to the current program control signal applied to a gate terminal of the second switching transistor;

a third switching transistor having a source terminal connected both to the anode of the OLED and the source terminal of the second switching transistor, and having a drain terminal connected to a power terminal, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

16. The current feedback-type AMOLED driving circuit according to claim 3, wherein each of the pixel circuits comprises:

an OLED having an anode connected to a power terminal;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to a drain terminal of the driving transistor, and a drain terminal connected to the sense terminal, thus the second switching transistor is switched in response to the current program control signal applied to a gate terminal of the second switching transistor;

a third switching transistor having a source terminal connected both to the drain terminal of the driving transistor and to the source terminal of the second switching transistor, and having a drain terminal connected to a cathode of the OLED, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

17. The current feedback-type AMOLED driving circuit according to claim 3, wherein each of the pixel circuits comprises:

an OLED;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to a cathode of the OLED, and having a drain terminal connected to the sense terminal, thus the second switching transistor is switched in response to the current program control signal applied to a gate terminal of the second switching transistor;

a third switching transistor having a source terminal connected to an anode of the OLED, and a drain terminal connected to a power terminal, thus the third switching transistor is switched in response to an illumination control signal, which is applied to a gate terminal of the third switching transistor and performs a control operation to cause previously programmed current to continuously flow; and a storage capacitor connected in parallel between the gate terminal and source terminal of the driving transistor.

18. The current feedback-type AMOLED driving circuit according to claim 3, wherein each of the pixel circuits comprises:

an OLED having a cathode connected to ground;

a driving transistor having a source terminal connected to an anode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to the drain terminal of the driving transistor, and a drain terminal connected to the sense terminal, thus the second switching transistor is switched in response to the current program control signal applied to a gate terminal of the second switching transistor;

a third switching transistor having a drain terminal connected both to the drain terminal of the driving transistor and to the source terminal of the second switching transistor, and having a source terminal connected to a power terminal, thus the third switching transistor is switched in response to the current program control signal applied to a gate terminal of the third switching transistor; and a storage capacitor connected in parallel between the gate terminal of the driving transistor and the cathode of the OLED.

19. The current feedback-type AMOLED driving circuit according to claim 3, wherein each of the pixel circuits comprises:

an OLED;

a driving transistor having a drain terminal connected to a cathode of the OLED, and a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to an anode of the OLED, and a drain terminal connected to the sense terminal, thus the second switching transistor is switched in response to the current program control signal applied to a gate terminal of the second switching transistor;

a third switching transistor having a drain terminal connected both to an anode of the OLED and to the source terminal of the second switching transistor, and having a source terminal connected to a power terminal, thus the third switching transistor is switched in response to the current program control signal applied to a gate terminal of the third switching transistor; and a storage capacitor connected in parallel between the gate terminal and the source terminal of the driving transistor.

20. The current feedback-type AMOLED driving circuit according to claim 3, wherein each of the pixel circuits comprises:

an OLED having an anode connected to a power terminal;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected to the drain terminal of the driving transistor, and a drain terminal connected to the sense terminal, thus the second switching transistor is switched in response to the current program control signal applied to a gate terminal of the second switching transistor;

a third switching transistor having a drain terminal connected both to the drain terminal of the driving transistor and to the source terminal of the second switching transistor, and having a source terminal connected to a cathode of the OLED, thus the third switching transistor is switched in response to the current program control signal applied to a gate terminal of the third switching transistor; and a storage capacitor connected in parallel between the gate terminal and the source terminal of the driving transistor.

21. The current feedback-type AMOLED driving circuit according to claim 3, wherein each of the pixel circuits comprises:

an OLED;

a driving transistor having a source terminal connected to ground;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to a cathode of the OLED, and having a drain terminal connected to the sense terminal, thus the second switching transistor is switched in response to the current program control signal applied to a gate terminal of the second switching transistor;

a third switching transistor having a drain terminal connected to an anode of the OLED, and a source terminal connected to a power terminal, thus the third switching transistor is switched in response to the current program control signal applied to a gate terminal of the third switching transistor; and a storage capacitor connected in parallel between the gate terminal and the source terminal of the driving transistor.

22. The current feedback-type AMOLED driving circuit according to claim 3, wherein each of the pixel circuits comprises:

an OLED having an anode connected to a power terminal;

a driving transistor having a source terminal connected to ground, and a drain terminal connected to a cathode of the OLED;

a first switching transistor having a source terminal connected to a gate terminal of the driving transistor, and a drain terminal connected to the data terminal, thus the first switching transistor is switched in response to a current program control signal applied to a gate terminal of the first switching transistor;

a second switching transistor having a source terminal connected both to the drain terminal of the driving transistor and to the cathode of the OLED, and having a drain terminal connected to the sense terminal, thus the second switching transistor is switched in response to the current program control signal applied to a gate terminal of the second switching transistor; and a storage capacitor connected in parallel between the gate terminal and the source terminal of the driving transistor.

* * * * *